United States Patent [19]

Reed

[11] 4,067,202

[45] Jan. 10, 1978

[54] SINGLE POINT MOORING BUOY AND TRANSFER FACILITY

[75] Inventor: Edwin E. Reed, Bartlesville, Okla.

[73] Assignee: Phillips Petroleum Company, Bartlesville, Okla.

[21] Appl. No.: 681,969

[22] Filed: Apr. 30, 1976

[51] Int. Cl.[2] ..... E02D 21/00

[52] U.S. Cl. ..... 61/86; 61/105; 166/.5; 141/388

[58] Field of Search ..... 61/86, 95, 94, 69 R, 61/105; 9/8 P; 114/.5 R, .5 T, .5 D; 137/355.16, 615; 141/387, 389, 388, 382; 166/.5, .6

[56] References Cited

U.S. PATENT DOCUMENTS

| | | | |
|---|---|---|---|
| B 390,679 | 1/1975 | Todd et al. | 166/.5 |
| 2,146,948 | 2/1939 | Feykert et al. | 141/382 |
| 2,648,201 | 8/1953 | Marancik et al. | 114/.5 T X |
| 2,704,620 | 3/1955 | Perri et al. | 141/388 X |
| 3,189,098 | 6/1965 | Haeber | 166/.6 |
| 3,472,032 | 10/1969 | Howard | 61/95 |
| 3,473,337 | 10/1969 | Carter | 61/69 R |
| 3,635,253 | 1/1972 | Johnson et al. | 137/799 |
| 3,654,951 | 4/1972 | Pogonowski et al. | 137/355.16 |
| 3,667,239 | 6/1972 | Mott | 61/95 |
| 3,670,515 | 6/1972 | Lloyd | 61/95 |
| 3,677,310 | 7/1972 | Dobler et al. | 141/388 X |
| 3,721,260 | 3/1973 | Stahmer | 137/615 X |
| 3,913,668 | 10/1975 | Todd et al. | 166/.5 |

FOREIGN PATENT DOCUMENTS

| | | | |
|---|---|---|---|
| 1,068,140 | 10/1959 | Germany | 141/389 |

*Primary Examiner*—Dennis L. Taylor

[57] ABSTRACT

A single point mooring and transfer facility is provided which comprises a floating buoy, a submerged platform, means for maintaining the floating buoy in position relative to the platform and a conduit means between the platform and the buoy. The conduit means has a coiled portion with its axis substantially vertical. The coiled portion provides the necessary flexibility between the floating buoy and the submerged platform, thus avoiding any requirement for flexible hoses and/or undersea swivel connections.

12 Claims, 4 Drawing Figures

SINGLE POINT MOORING BUOY AND TRANSFER FACILITY

This invention relates to the production of petroleum fluids from marine wells.

Offshore producing gas fields great distances from land often do not warrant pipeline installations. Many of the world's established gas fields are too small to justify building permanent piping and production facilities. Many gas fields are located in areas where the underwater terrain makes pipeline installations unfeasible. It has been proposed to recover gas from marine wells by liquefying and storing the gas until an LNG (liquefied natural gas) tanker ship can transport the fuel to a market port. It has also been proposed to install petrochemical complexes on seagoing, self-propelled ships to convert such gas to products such as anhydrous ammonia or urea.

While these recovery methods represent viable alternatives either to not recovering the gas or burning off oilfield by-product gas, there remains the problem of transferring the gas from the undersea floor to the surface. In relatively shallow water areas, e.g., 50 to 100 feet, the production or transfer facility can be built using dry land techniques. In deeper waters, it becomes impractical or too expensive to establish fixed platform means to support the production facilities. For this reason, a number of approaches have been proposed in the past for storing and treating production fluid from underwater wells in deep water and remote locations. For example, floating production platforms have been positioned over the desired well sites for the reception and/or treatment of production fluids. However, such floating production platforms have the disadvantage that they normally require the use of flexible pipelines and a means of making underwater pipeline connections. In addition, floating production platforms of this nature are required to be maintained in a relatively stable position to fulfill their function, and the maintenance of such stability becomes increasingly difficult during storms or other periods of great wave excitation or atmospheric disturbances influencing the dynamic behavior of the floating platform. Further, many of the platforms and the mooring systems heretofore provided in attempts to improve the platform stability and the wellhead connection have either been too complex or too costly to be practical.

The undersea connections can be troublesome, particularly when the gas is under relatively high pressure. Maintenance of undersea flexible hose lines and/or swivel connections is both expensive and time-consuming. Undersea flexible hose lines are more subject to rupture than a solid metal pipeline; and universal or swivel-type connections are easily susceptible to damage.

Accordingly, an object of this invention is to provide a new and improved flow line system for connecting a sea floor pipeline to a floating buoy.

Other objects, aspects and advantages of the present invention will be apparent to those skilled in the art from the following description, appended claims and attached drawings.

In accordance with the present invention there is provided a single point mooring and transfer facility comprising a floating buoy, a submerged platform, means for maintaining the buoy in position relative to the platform, first conduit means for conducting fluid to and from the platform, second conduit means for conducting fluid to and from the buoy, and third conduit means connecting the first conduit means and the second conduit means which third conduit means has a coiled portion, the axis of which is disposed substantially vertical.

All of the above conduit means are metal pipe such as that commonly used in riser pipes in offshore drilling operations. An important advantage of the present invention is that there are no hose or other flexible connections at any point in the conduit system, only hard piping, thus reducing the need for maintenance by diving personnel.

In accordance with one embodiment of the present invention, the third conduit means is a continuous helix extending substantially from the undersea platform to the floating buoy.

In accordance with another embodiment of this invention the coiled portion of the third conduit means is housed within the undersea platform, this coiled portion being a spiral coil.

In accordance with yet another embodiment of the present invention the coiled portion of the third conduit means is a helix extending from the submerged platform toward the floating buoy, but less than the total distance from the platform to the buoy.

In a further embodiment of the present invention the floating buoy is maintained in position relative to the submerged platform by a plurality of anchor lines.

In a yet further embodiment of the present invention the floating buoy is maintained in position relative to the submerged platform by a flexibly connected spar.

A better understanding of the invention will be had from the following detailed description taken with the drawings, in which.

Figure 1:
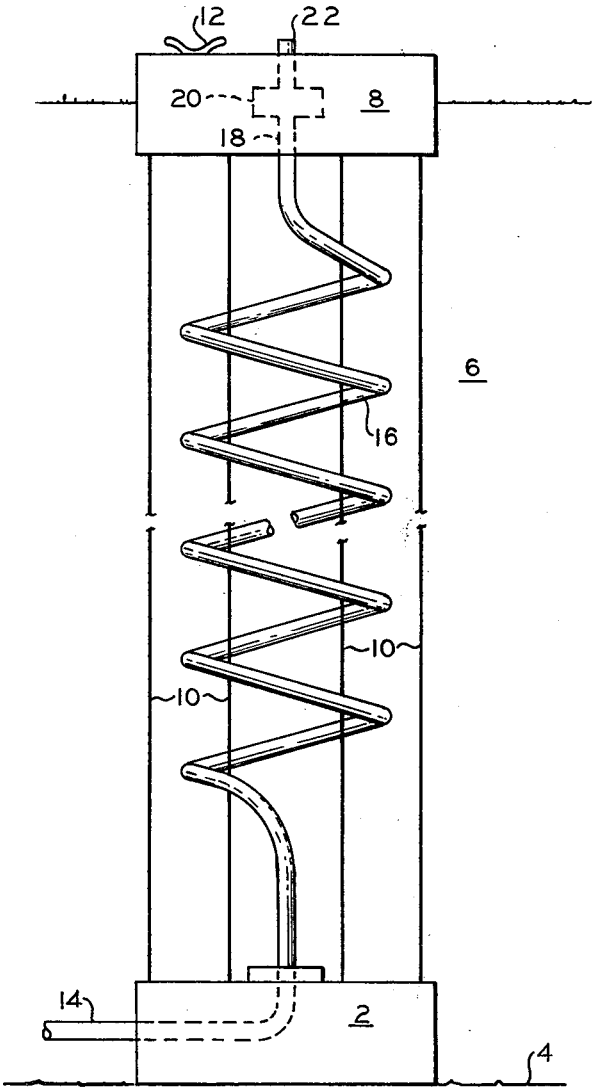
FIG. 1 illustrates the mooring and transfer facility according to the present invention positioned in a body of water with the various components of the facility in operative engagement.

Referring now to the drawings, FIG. 1 shows a submerged platform 2 at the bottom 4 of a body of water 6. Floating in the body of water 6 is floating buoy 8. The submerged platform 2 is anchored to the bottom 4, e.g., by gravity, by piles (not shown). Buoy 8 is maintained in position relative to platform 2 by cables 10. The buoy 8 has mooring means 12.

An underwater gas line 14 conducts gas from underwater wells, not shown, to the submerged platform 2, from which the gas is passed upwardly through conduit means 16 to the floating buoy 8. The gas is conducted through the buoy by conduit means 18 having a valve means 20 to cut off the gas flow, to an outlet 22 so that a suitable connection can be made thereto. In the embodiment illustrated in FIG. 1, the conduit means 16 is shown as a continuous helix, having an essentially vertically disposed axis extending substantially the total distance from the submerged platform to the base of the floating buoy. As the buoy 8 moves in response to wave action, the helix 16 flexes and thereby prevents rupture between platform 2 and buoy 8. The invention thus provides a means for connecting an underwater pipeline to a floating buoy without the use of flexible lines, e.g.

hoses, or moving parts such as would be found in a universal or swivel type of pipe connection.

Figure 2:
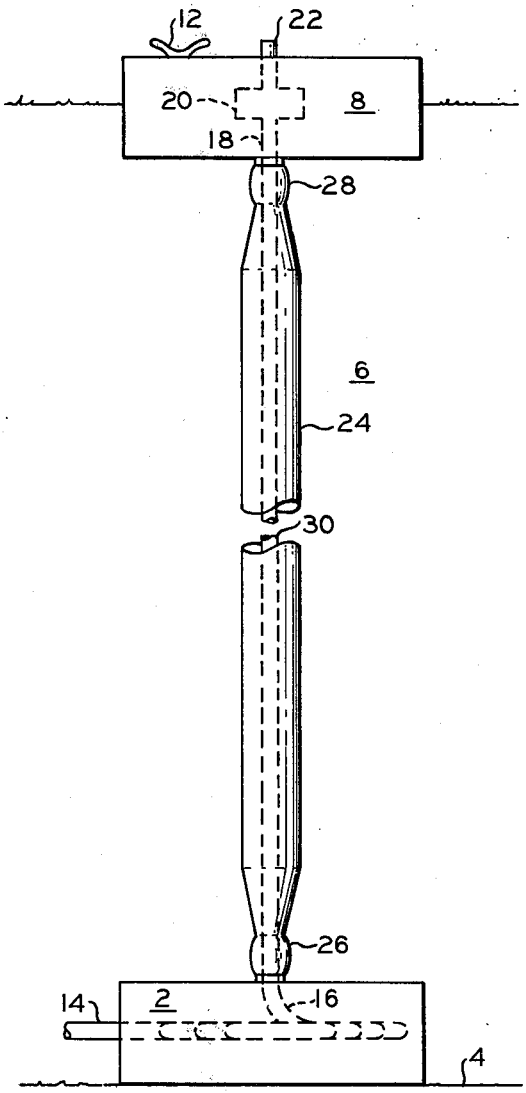
FIG. 2 is similar to FIG. 1 and illustrates an alternative embodiment.
Figure 3:
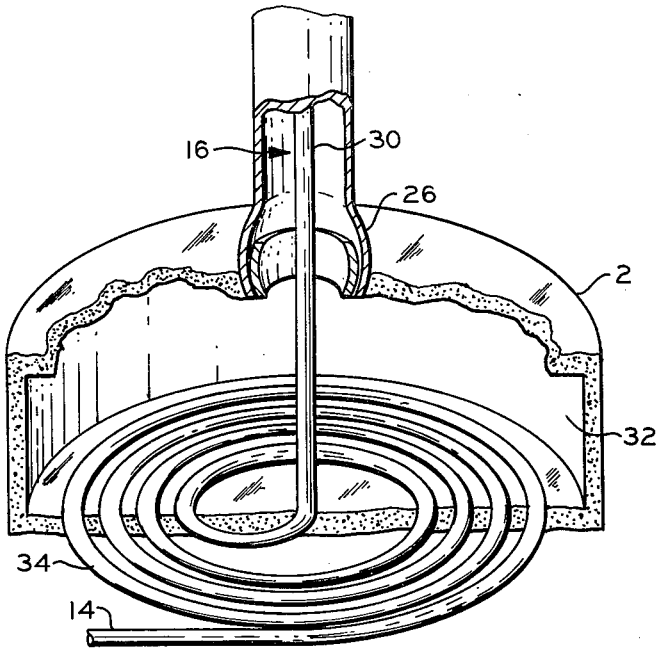
FIG. 3 illustrates the submerged platform of FIG. 2.

FIGS. 2 and 3 illustrate a single point mooring and transfer facility in which the buoy 8 is maintained in position relative to platform 2 by a single spar 24. The spar is flexibly connected to platform 2 by an articulated joint 26 of known type permitting the passage of the conduit means 16 therethrough. The spar is connected to the buoy 8 by a similar connection 28. In this embodiment the conduit means 16 is shown as a straight portion 30 extending from the submerged platform 2 to the buoy 8. FIG. 3 shows the submerged platform 2 in greater detail. The platform 2 has a cavity 32 which houses a spiral coiled portion 34 of the conduit means 16. The straight portion 30 of the conduit means passes upwardly from the submerged platform 2 to the buoy 8 through the spar 24. As the buoy 8 moves in response to wave action, such movement is transmitted by the straight portion 30 of the conduit means to the coiled portion 34 in the submerged platform. The spiral coil portion 34 flexes and thereby prevents rupture between the platform 2 and the buoy 8.

Figure 4:
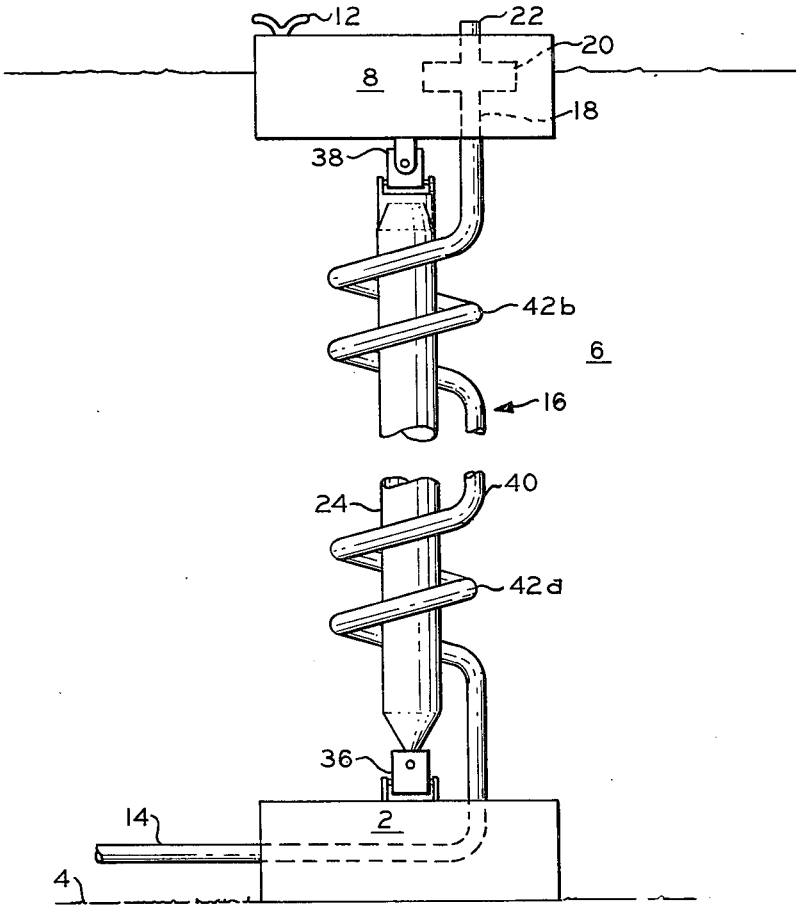
FIG. 4 is similar to FIG. 1 and illustrates yet another embodiment.

FIG. 4 illustrates a single point mooring and transfer facility in which the buoy 8 is maintained in position relative to platform 2 by a single spar 24. The spar 24 is flexibly connected to platform 2 and buoy 8 by universal joints 36 and 38, respectively. In this embodiment the conduit means 16 is shown as a straight portion 40 connected to coiled portions 42*a* and 42*b*.

The dimensions of the coiled portion of the third conduit meals will vary according to the depth of water at the location of the mooring and transfer facility of this invention, sea conditions at the location, size of the conduit member, the material of construction and the like. However, as an example, it is contemplated that in a water depth of about 300 fert, the helix configuration, as illustrated in FIGS. 1 and 4, using 16-inch pipe will require at least five turns and a helix diameter of 50–60 feet. The spiral configuration shown in FIGS. 2 and 3 would require a total spiral diameter of 50–60 feet with about a 5-foot spacing between turns of the spiral, using 16-inch pipe in the same depth of water.

Thus, it can be seen that the invention provides an improved single point mooring and transfer facility having no deep water hose and/or swivel connections in the fluid transfer conduit means, thus avoiding the maintenance required for such components in deep-water service.

While the invention has been described with particular reference to the transfer of gas, under high pressure, from the ocean floor to the surface, it will be appreciated by those skilled in the art that the apparatus of this invention can also be employed for conveying liquid petroleum and other products. The apparatus of the present invention can also be employed to offload fluids from a vessel to a submerged pipeline.

Reasonable variations and modifications, which will be apparent to those skilled in the art, can be made in this invention without departing from the spirit and scope thereof.

I claim:

1. A single point mooring and transfer facility comprising:

a floating buoy, a submerged platform, means for maintaining said buoy in position relative to said platform, first conduit means for conducting fluid to and from said platform, second conduit means for conducting fluid to and from said buoy, and third conduit means connecting said first conduit means and said second conduit means, said third conduit means consisting essentially of a straight portion extending from said platform to said buoy and a spiral coiled portion having a substantially vertical axis housed within said platform.

2. The facility of claim 1 wherein said position maintaining means comprises a plurality of cables.

3. The facility of claim 1 wherein said position maintaining means consists of a single spar flexibly connected to both said buoy and said platform, wherein said straight portion of said third conduit means is housed within said spar.

4. The facility of claim 1 wherein said third conduit means has a diameter of about 16 inches and said spiral portion a diameter of about 50 to 60 feet.

5. A single point mooring and transfer facility comprising:

a floating buoy, a submerged platform, means for maintaining said buoy in position relative to said platform, first conduit means for conducting fluid to and from said platform, second conduit means for conducting fluid to and from said buoy, and third conduit means connecting said first conduit means and said second conduit means, said third conduit means consisting essentially of a circular helix having a substantially vertical axis extending substantially from said platform to said buoy.

6. The facility of claim 5 wherein said position maintaining means comprises a plurality of cables.

7. The facility of claim 5 wherein said position maintaining means consists of a single spar flexibly connected to both said buoy and said platform.

8. The facility of claim 5 wherein said third conduit means has a diameter of about 16 inches and said helix has a diameter of about 50 to 60 feet.

9. A single point mooring and transfer facility comprising:

a floating buoy, a submerged platform, means for maintaining said buoy in position relative to said platform, first conduit means for conducting fluid to and from said platform, second conduit means for conducting fluid to and from said buoy, and third conduit means connecting said first conduit means and said second conduit means, said third conduit means consisting essentially of a circular helix extending from said submerged platform toward said floating buoy but less than the total distance from said platform to said buoy, with the remainder of said distance being a substantially straight portion, wherein the axis of said helix is substantially vertical.

10. The facility of claim 9 wherein said position maintaining means comprises a plurality of cables.

11. The facility of claim 9 wherein said position maintaining means consists of a single spar flexibly connected to both said buoy and said platform.

12. The facility of claim 9 wherein said third conduit means has a diameter of about 16 inches and said helix has a diameter of about 50 to 60 feet.

* * * * *